US009714744B2

(12) United States Patent
Van Bommel et al.

(10) Patent No.: US 9,714,744 B2
(45) Date of Patent: Jul. 25, 2017

(54) LIGHTING DEVICE

(71) Applicant: PHILIPS LIGHTING HOLDING B.V., Eindhoven (NL)

(72) Inventors: Ties Van Bommel, Horst (NL); Rifat Ata Mustafa Hikmet, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/769,828

(22) PCT Filed: Feb. 14, 2014

(86) PCT No.: PCT/IB2014/058992
§ 371 (c)(1),
(2) Date: Aug. 24, 2015

(87) PCT Pub. No.: WO2014/128601
PCT Pub. Date: Aug. 28, 2014

(65) Prior Publication Data

US 2015/0377425 A1 Dec. 31, 2015

Related U.S. Application Data

(60) Provisional application No. 61/768,590, filed on Feb. 25, 2013.

(51) Int. Cl.
*F21V 11/14* (2006.01)
*F21K 99/00* (2016.01)
(Continued)

(52) U.S. Cl.
CPC ..... *F21K 9/50* (2013.01); *F21K 9/60* (2016.08); *F21V 9/16* (2013.01); *F21V 11/14* (2013.01); *F21Y 2115/10* (2016.08)

(58) Field of Classification Search
CPC ... F21V 11/14; F21V 9/10; F21V 9/16; F21V 9/62; F21V 9/64; F21K 9/60; F21K 9/62; F21K 9/64
(Continued)

(56) References Cited

U.S. PATENT DOCUMENTS 4,214,168 A 7/1980 Kulka
2004/0095746 A1 5/2004 Murphy
(Continued)

FOREIGN PATENT DOCUMENTS

EP 1843081 A2 3/2007
GB 1125060 A 8/1968
WO 2010131129 A1 11/2010

*Primary Examiner* — Julie Bannan

(57) ABSTRACT

A lighting device (11, 12, 13, 14) comprising a light source (101, 102, 103, 104) emitting light, and at least one optical element (30, 301, 302, 303, 304) arranged in front of said light source, said at least one optical element comprising an at least partially transparent material such as to allow at least part of the light emitted by the light source to be transmitted therethrough, wherein said at least one optical element comprises a plurality of through openings (20, 201, 211, 202, 212, 203, 213, 204, 214) adapted for collimating said light emitted by said light source such as to cause light exiting said at least one optical element to comprise a brightness varying with the direction in which said light exits said at least one optical element.

14 Claims, 4 Drawing Sheets

(51) Int. Cl.
*F21V 9/16* (2006.01)
*F21K 9/60* (2016.01)
*F21Y 115/10* (2016.01)

(58) Field of Classification Search
USPC ..... 362/290, 293, 311.12
See application file for complete search history.

(56) References Cited

U.S. PATENT DOCUMENTS

| | | | | |
|---|---|---|---|---|
| 2007/0211474 | A1 | 9/2007 | Chen et al. | |
| 2010/0127289 | A1* | 5/2010 | Helbing | H01L 33/508 257/98 |
| 2010/0328926 | A1* | 12/2010 | Hoelen | C09K 11/7774 362/84 |
| 2011/0044026 | A1* | 2/2011 | Deeben | H01L 33/508 362/84 |
| 2011/0267835 | A1 | 11/2011 | Boonekamp et al. | |
| 2011/0298371 | A1 | 12/2011 | Brandes et al. | |
| 2012/0014132 | A1* | 1/2012 | Chiang | G02F 1/133606 362/607 |
| 2012/0218752 | A1 | 8/2012 | Sumitani | |

* cited by examiner

LIGHTING DEVICE

CROSS-REFERENCE TO PRIOR APPLICATIONS

This application is the U.S. National Phase application under 35 U.S.C. §371 of International Application No. PCT/IB14/058992, filed on Feb. 14, 2014, which claims the benefit of U.S. Provisional Patent Application No. 61/768,590, filed on Feb. 25, 2013. These applications are hereby incorporated by reference herein.

FIELD OF THE INVENTION

The invention relates to a lighting device comprising a light source emitting light and at least one optical element arranged in front of said light source.

BACKGROUND OF THE INVENTION

In lighting applications it is desirable to produce light sources showing sparkling effects. Such effects are usually produced using refractive optical components placed in front of a LED light source. An example is described in WO 2010/131129 A1.

In this way, high intensity light sources can produce such sparkling effects for applications such as e.g. LED candle lamps. For many applications, it is also important to produce such effects for aesthetics. However, multiple refractive components for light sources are rather expensive, and the larger the size of the refractive component required, the more expensive it is.

Furthermore, in some applications, such as retrofit capsules, it has been shown that the lumen output can be increased considerably by using a phosphor arranged in a distance from the light source. In such an arrangement, however, any sparkling effect otherwise provided for disappears.

Furthermore, US 2012/0218752 A1 describes a lighting module for a backlight unit such as a liquid crystal display. This lighting module comprises a light source, a diffuser arranged in front of the light source and a reflective sheet arranged between the light source and the diffuser and provided with holes, the reflective sheet being arranged at a distance from both light source and diffuser. The reflective sheet serves the purpose of blocking part of the light emitted by the light source, such that the amount of light transmitted through the reflective sheet corresponds to the amount of light transmitted through the holes therein. The aim of this lighting module is to obtain a uniform illumination light with reduced variations in brightness. Therefore this solution does not provide any sparkling effect.

Hence, the prior art solutions provide either a sparkling effect, these solutions being rather expensive, or a high lumen light output. Such lighting devices consequently provide a light output, which is perceived as unsatisfactory by a viewer in terms of light intensity, aesthetical appearance or both.

SUMMARY OF THE INVENTION

It is an object of the present invention to overcome the above-mentioned problems, and to provide a lighting device of the type mentioned initially which is capable of producing a sparkling effect in a simple and cost-efficient manner and without compromising the lumen output.

According to the invention, this and other objects are achieved with a lighting device as described initially and in which the at least one optical element comprises an at least partially transparent material such as to allow at least part of the light emitted by the light source to be transmitted therethrough, and the at least one optical element comprises a plurality of through openings adapted for collimating the light emitted by the light source such as to cause light exiting the at least one optical element to comprise a brightness varying with the direction in which the light exits the at least one optical element.

Such a variation in brightness is by a viewer experienced as a sparkling effect when the viewer changes his or her point of view with respect to the lighting device, e.g. when passing by the lighting device.

Hence, with such a lighting device it is ensured that a sparkling effect is provided in a very simple and durable manner due to the provision of through holes in the optical element, while at the same time ensuring a high lumen output.

Furthermore, optical elements comprising an at least partially transparent material and thereby being at least partially transparent are simpler in structure and less expensive to produce as compared to diffractive elements. Therefore a lighting device which is simple in structure and cost effective to produce is obtained.

In an embodiment, the lighting device comprises at least two optical elements arranged in front of the light source, the at least two optical elements comprise an at least partially transparent material such as to allow at least part of the light emitted by the light source to be transmitted therethrough, wherein the at least two optical elements comprise a plurality of through openings adapted for collimating the light emitted by the light source such as to cause light exiting the at least two optical elements to comprise a brightness varying with the direction in which the light exits the at least two optical elements.

With such a lighting device a further improved sparkling effect is obtained.

In an embodiment the at least two optical elements are arranged mutually spaced apart. Thereby it is possible to obtain the same sparkling effect with two relatively thin optical elements as with one correspondingly thick optical element, which in turn provides for an even more inexpensive lighting device.

The at least one optical element may be any one of a phosphor element and a diffuser.

Such an optical element is particularly suitable for use in lighting devices to obtain a light output fulfilling the requirements for lighting devices such as lamps or luminaires for use in indoor illumination purposes. Also, in case of a phosphor element, variations in color and/or color temperatures may be obtained.

The at least one optical element may be arranged in contact with the light source, or it may be arranged at a distance from the light source.

In an embodiment, a diffuser is arranged between the light source and the at least one optical element.

Thereby a lighting device is obtained with which a uniform light distribution is obtained before transmission through the one or more optical elements providing the variation in brightness and thus the sparkling effect.

In an embodiment, any one of a phosphor element, a phosphor layer and a phosphor coating is arranged between the light source and the at least one optical element.

This embodiment is particularly suitable for lighting devices employing an LED, particularly a white LED, as a light source. In such a case, the provision of a phosphor, whether element, layer, coating or otherwise, provides for a distribution of the light emitted by the lighting device covering the nearly full or full spectrum of visible light. Thereby a lighting device is obtained with which a uniform light distribution is obtained before transmission though the one or more optical elements providing the variation in brightness and thus the sparkling effect.

In a further embodiment the plurality of through openings may comprise two or more different sizes.

In a further embodiment the plurality of through openings may comprise two or more different cross sectional shapes.

Thereby a lighting device is obtained with which the variation in brightness and thus the sparkling effect may be adjusted according to requirements by adjusting the size and/or cross sectional shape of one or more of the through openings.

In an embodiment, the at least two optical elements comprise a different number of through openings.

Thereby another parameter for adjusting the distribution and brightness of the emitted light as well as the variation in brightness and thus the sparkling effect is obtained.

In an embodiment, one or more of the plurality of through openings are filled with a material being different to that of the optical element.

In an embodiment, one or more of the plurality of through openings are filled with an optical rod.

Thereby yet another parameter for adjusting the distribution and brightness of the emitted light as well as the variation in brightness and thus the sparkling effect is obtained. Furthermore, filling at least one of the through openings with a material being different to that of the optical element or with an optical rod provides for improved collimation of the light emitted by the lighting device. Particularly, in case of an optical rod the collimation may be obtained by total internal reflection (TIR) in the optical rod.

In an embodiment, the at least one optical element comprises a non-uniform thickness.

Thereby a further parameter for adjusting the distribution and brightness of the emitted light as well as the variation in brightness and thus the sparkling effect is obtained.

Likewise, the shape of the at least one optical element may in principle be any shape such as flat, rounded, stepped, buckled and so forth. Naturally the shape of the light source may also in principle be any shape such as flat, rounded, stepped, buckled and so forth. Also, the optical element(s) and the light source need not have the same shape, but may have different shapes.

In an embodiment, the plurality of through openings comprise an aspect ratio measured as the length of the through opening divided by the diameter of the through opening of at least 2.

Thereby a particularly good and satisfactory variation in brightness and thus the sparkling effect is provided.

In another embodiment the at least one optical element comprises an aspect ratio of at least 4. In yet another embodiment the at least one optical element comprises an aspect ratio of at least 6.

Another parameter usable for adjusting the distribution and brightness of the emitted light is for the thickness of the at least one optical element. The at least one optical element may e.g. comprise a thickness of at least 0.1 mm, at least 0.2 mm, at least 0.5 mm, at least 1 mm or at least 2 mm.

Preferably, the light source is any one of a LED, a phosphor-converted LED, a LED-array, a phosphor-converted LED-array and a light guide.

The invention also relates to a luminaire or a lamp comprising a lighting device according to the invention.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

Figure 1:
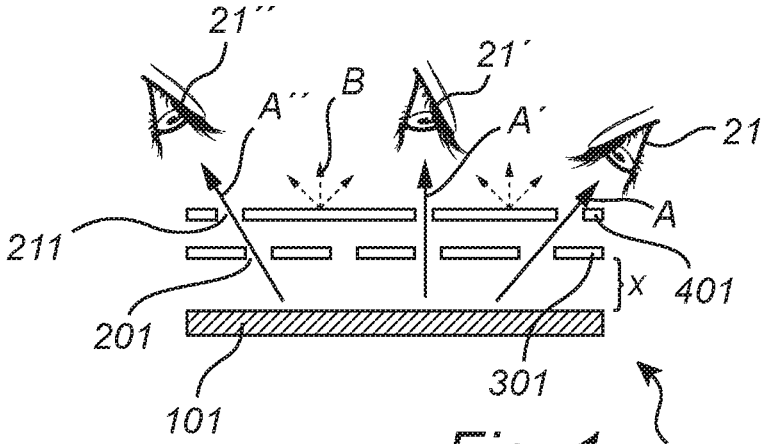
FIGS. 1 to 3 show schematic illustrations of three different versions of a first embodiment of a lighting device according to the invention comprising a light source and two optical elements in the form of phosphor elements with through holes.

As illustrated in the figures, the sizes of layers and regions are provided to illustrate the general structures of embodiments of the present invention. Like reference numerals refer to like elements throughout, such that in reference numerals comprising three digits, the first two digits refer to the element, while the last digit, i.e. 1, 2, 3 or 4, refers to the corresponding embodiment.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein, rather, these embodiments are provided for thoroughness and completeness, and fully convey the scope of the invention to the skilled person.

Generally speaking and irrespective of the embodiment a lighting device 11, 12, 13, 14 according to the invention comprises a light source 101, 102, 103, 104 and at least one optical element 30, 301, 401, 302, 303, 403, 404 arranged in front of the light source. The at least one optical element comprises a material being at least partially transparent, such that light may be transmitted through the at least optical element, and particularly through the material thereof between the through openings described below. It is in this connection noted that the material may in principle be of any color, and that the term "at least partially transparent" encompasses both materials with both transparent and non-transparent regions and materials not being 100% transparent. The at least one optical element may furthermore e.g. be a plate-shaped element or a film or foil or any combination thereof.

The at least one optical element comprises a plurality of through openings 20, 20', 201, 211, 221, 231, 202, 212, 222, 232, 203, 213, 204, 214 adapted for collimating light emitted by the light source. Thereby light emitted by said light source is provided with brightness varying with the direction of emission, i.e. a sparkling effect is produced when the viewer changes his or her point of view with respect to the lighting device 11, 12, 13, 14, e.g. when passing by the lighting device 11, 12, 13, 14.

In the embodiments shown on the figures and described further below one or two optical elements 30, 301, 401, 302, 303, 403, 404 are shown. Naturally, however, any number of optical elements larger or smaller than the one or two shown, e.g. one, three, four or five optical elements, may in principle be provided for irrespective of the embodiment.

Likewise common to all embodiments of a lighting device according to the invention is that the at least one optical element 30, 301, 302, 303, 304, and in embodiments comprising two or more optical elements one of the at least two optical elements, may be arranged:

in contact with or on top of or directly on top of the light source, or at a distance x from the light source.

The distance x may be chosen such that the at least one optical element 30, 301, 302, 303, 304, and in embodiments comprising two or more optical elements one of the at least two optical elements, may be arranged:

at a small distance x from the light source, e.g. 1 mm or 2 mm or 3 mm or 5 mm, chosen such that the at least one optical element is arranged in a vicinity of the light source, or at a larger distance x from the light source, e.g. 2 cm or 3 cm or 5 cm, chosen such that the at least one optical element is arranged remotely from the light source.

The thickness of the at least one optical element 30, 301, 401, 302, 303, 403, 404 may be e.g. at least 0.5 mm, at least 1 mm, at least 2 mm, or at least 3 mm.

Likewise common to all embodiments of a lighting device according to the invention comprising two or more optical elements, the at least two optical elements may be arranged:

mutually spaced apart, or in contact with one another.

Also, any number of through openings 20, 20', 201, 211, 221, 231, 202, 212, 222, 232, 203, 213, 204, 214 may in principle be provided in the at least one optical element. In this connection it is noted that, at least to a certain extend, a larger number of through openings will cause more variations in brightness over the area of the optical element, and in consequence the viewer will experience a more intense sparkling effect when changing his or her point of view with respect to the lighting device.

Furthermore it is common to all embodiments of a lighting device according to the invention that the through openings 20, 20', 201, 211, 221, 231, 202, 212, 222, 232, 203, 213, 204, 214 provided in the at least one optical element, and in embodiments comprising two or more optical elements in the at least two optical elements, may comprise:

different sizes, such as different cross sectional diameters and/or different lengths, and/or different orientations with respect to the opposite surfaces of the optical element through which optical element and between which opposite surfaces the through openings extend, and/or different cross sectional shapes, such as circular, elliptic, triangular, rectangular or polygonal.

These parameters relating to the through openings all provide for possibilities of varying the pattern and/or brightness of the sparkling effect obtained.

Finally it is common to all embodiments of a lighting device according to the invention that one, or possibly more than one, additional phosphor element, phosphor layer 803, 804, phosphor coating or diffuser 501, 502, 503, 504 may be arranged between the light source and the optical element(s).

The light source 101, 102, 103, 104 may be LEDs, UV LEDs or laser diodes, but other light sources are equally conceivable. For instance, the LEDs may be flat-surface LED semiconductors chips, RGB LEDs, direct phosphor converted LEDs, or blue LEDs, violet LEDs, or UV LEDs combined with remote phosphor technology.

A lighting device according to the invention may be used in a wide variety of light emitting arrangements, particularly in lamps, light modules and luminaires.

As will be described below, the at least one optical element 30, 301, 401, 302, 303, 403, 404 may be a phosphor element 301, 401, 302 or a diffuser 303, 403, 404.

In case of the at least one optical element being a phosphor element, the material used may be an organic phosphor, an inorganic phosphor or quantum dots.

Examples of suitable organic phosphor materials are organic luminescent materials based on perylene derivatives, for example compounds sold under the name Lumogen® by BASF. Examples of suitable compounds include, but are not limited to, Lumogen® Red F305, Lumogen® Orange F240, Lumogen® Yellow F083, and Lumogen® F170.

Examples of inorganic phosphor materials include, but are not limited to, cerium (Ce) doped YAG (Y3Al5O12) or LuAG (Lu3Al5O12). Ce doped YAG emits yellowish light, whereas Ce doped LuAG emits yellow-greenish light. Examples of other inorganic phosphors materials which emit red light may include, but are not limited to ECAS and BSSN, ECAS being Ca1−xA1SiN3:Eux wherein $0<x\leq1$, preferably $0<x\leq0.2$; and BSSN being Ba2−x−zMxSi5−yAlyN8−yOy:Euz wherein M represents Sr or Ca, $0\leq x\leq1$, $0\leq y\leq4$, and $0.0005\leq z\leq0.05$, and preferably $0\leq x\leq0.2$.

Quantum dots or rods are small crystals of semiconducting material generally having a width or diameter of only a few nanometers. When excited by incident light, a quantum dot emits light of a color determined by the size and material of the crystal. Light of a particular color can therefore be produced by adapting the size of the dots. Most known quantum dots with emission in the visible range are based on cadmium selenide (CdSe) with a shell such as cadmium sulfide (CdS) and zinc sulfide (ZnS). Cadmium free quantum dots such as indium phosphode (InP), copper indium sulfide (CuInS2) and/or silver indium sulfide (AgInS2) can also be used. Quantum dots show very narrow emission bands and thus they show saturated colors. Furthermore the emission color can easily be tuned by adapting the size of the quantum dots. Any type of quantum dot known in the art may be used in the present invention. However, it may be preferred for reasons of environmental safety and concern to use cadmium-free quantum dots or at least quantum dots having a very low cadmium content.

Also, it is noted that irrespective of the embodiment the lighting device may comprise an additional transparent top substrate with or without optical contact with the remaining lighting device. This substrate may protect the lighting device from dust and/or may be used for safety reasons, e.g. such that no water can come into the lighting device.

In the following four different embodiments illustrated in the drawings will be described. Focus will primarily be on the features of each embodiment by which the embodiments differ from one another.

Embodiment 1

FIG. 1 shows a lighting device 11 according to a first embodiment of the invention. The lighting device comprises a light source 101 and two optical elements 301, 401 arranged in front of the light source 101.

In this embodiment the two optical elements 301, 401 are phosphor elements that are at least partially transparent. The two optical elements 301, 401 each comprise a plurality of through openings 201, 211 for collimating light emitted by the light source 101 such as to cause light emitted by the light source 101 to comprise a brightness varying with the direction of emission and thereby provide a sparkling effect.

As illustrated in FIG. 1, viewers 21, 21' and 21" looking at the lighting device 11 from the directions A, A' and A", respectively, will experience light with a brightness corresponding to light transmitted through the through openings in both optical elements. A viewer looking at the light source from another direction, e.g. the direction B, will experience light transmitted through one or both optical elements 301, 401, and thus having a different, typically lower, brightness. Thereby a sparkling effect is obtained when a viewer changes his point of view, e.g. from the direction A over the direction B to the direction A'.

As shown in FIG. 1, the optical element 301 closest to the light source 101 is arranged at a distance x from the light source 101.

Furthermore, the optical element 301 shown in FIG. 1 comprises four through openings 201, while the optical element 401 comprises three through openings 211. That is, the optical element 301 comprises a larger number of through openings than the optical element 401.

Obviously each of the optical elements 301 and 401 are not limited to comprising this number of through openings but may comprise any other number of through openings, in principle including just one through opening. Also, the optical elements 301 and 401 may comprise an identical number of through openings, or the optical element 401 may comprise a larger number of through openings than the optical element 301.

The optical elements 301, 401 are in this embodiment provided with a relatively small thickness, e.g. a thickness of 0.1 mm or 0.2 mm, but may in principle also be provided with a larger thickness, e.g. a thickness of 0.5 mm, 1 mm, 2 mm or 3 mm. Also, the optical elements 301, 401 may be of different thicknesses.

Figure 2:
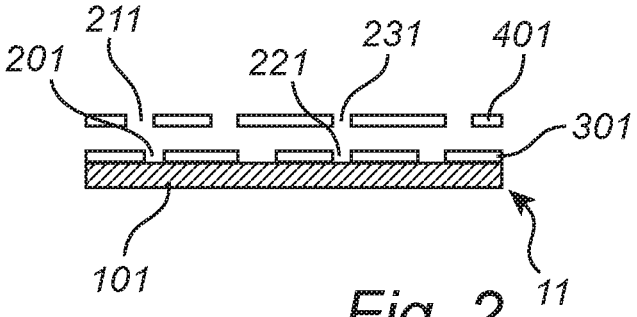

FIG. 2 shows a version of the lighting device 11 in which the optical element 301 closest to the light source 101 is arranged in contact with the light source 101.

Figure 3:
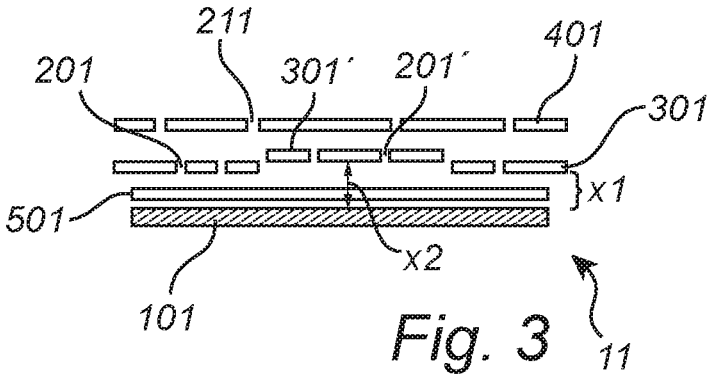

FIG. 3 shows another version of the lighting device 11 in which a diffuser 501 is arranged between the light source 101 and the optical elements 301 and 401. In this way a uniform light distribution may be obtained before transmitting the light through the optical elements 301 and 401 providing the sparkling effect.

Furthermore, the optical element 301 of the lighting device 11 shown in FIG. 3 is provided with a stepped configuration such that a part 301' of the optical element 301, which is provided with through openings 201', is arranged in a different distance x2 from the light source 101 than the remaining part of the optical element 301 provided with through openings 201, this remaining part being arranged in a distance x1 from the light source 101.

As shown in FIG. 3, the distance x2 is larger than the distance x1. However, the opposite, that the distance x1 is larger than the distance x2 is naturally also possible. Likewise the optical element 302 may be provided with a similar stepped configuration, while the optical element 301 is of a plane configuration, or both optical elements may be provided with a stepped configuration.

It is noted that obviously one or both optical element(s) may be provided with a stepped configuration as described above irrespective of the embodiment.

Embodiment 2

Figure 4:
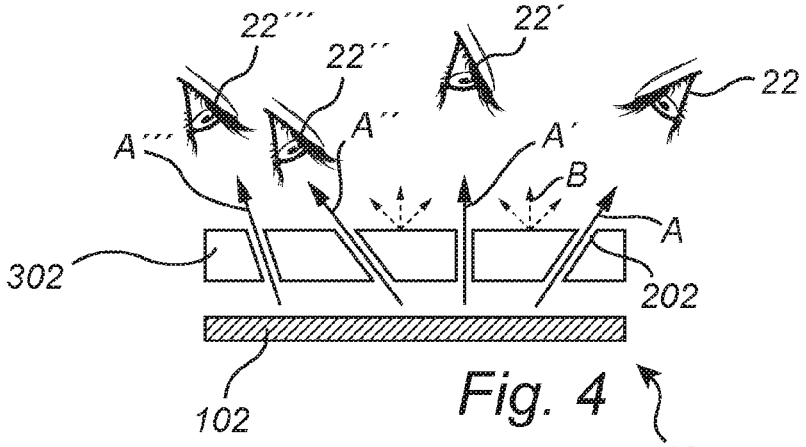
FIGS. 4 to 7 show schematic illustrations of four different versions of a second embodiment of a lighting device according to the invention comprising a light source and one optical element in the form of a phosphor element with an increased thickness as compared to the optical elements of the first embodiment and with through holes.

FIG. 4 shows a lighting device 12 according to a second embodiment of the invention. The lighting device comprises a light source 102 and one optical element 302 arranged in front of the light source 102.

In this embodiment the optical element 302 is a phosphor element that is at least partially transparent. The optical element 302 comprises a plurality of through openings 202, 212 for collimating light emitted by the light source 102 such as to cause light emitted by the light source 102 to comprise a brightness varying with the direction of emission and thereby provide a sparkling effect.

As illustrated in FIG. 4, viewers 22, 22', 22" and 22' looking at the lighting device 11 from the directions A, A', A" and A', respectively, will experience light with a brightness corresponding to light transmitted through the through openings 202 in the optical element 302. A viewer looking at the light source from another direction, e.g. the direction B, will experience light transmitted through the optical element 302, and thus having a different, typically lower, brightness. Thereby a sparkling effect is obtained when a viewer changes his point of view, e.g. from the direction A over the direction B to the direction A'.

The optical element 302 is in this embodiment provided with a relatively large thickness, e.g. a thickness of 0.5 mm, 1 mm, 2 mm or 3 mm, such that the through openings 202, 212 are provided as through channel- or closed-channel- or tube-shaped openings.

As will be described further below with respect to FIGS. 12 to 14, the through openings 202, 212 may have one specific cross sectional diameter when measured on one surface of the optical element 302 and another specific cross sectional diameter when measured on the opposite surface of the optical element 302.

The through openings 202, 212 typically have a large aspect ratio measured as the length of the through opening divided by the diameter of the through opening. The aspect ratio may e.g. be at least 2, or at least 4, or at least 6.

For example, an optical element 302 with a thickness of 2 mm might have holes with a diameter of 300 μm. In another example, an optical element 302 with a thickness of 1 mm might have holes with a diameter of 100 μm.

Furthermore, the optical element 302 shown in FIG. 4 comprises four through openings 202. Obviously the optical element 302 is not limited to comprising this number of through openings but may comprise any other number of through openings, in principle including just one through opening.

Figure 5:
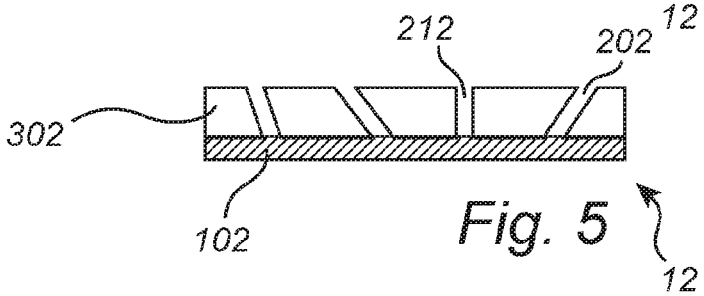

FIG. 5 shows a version of the lighting device 12 in which the optical element 302 is arranged in contact with the light source 102.

Figure 6:
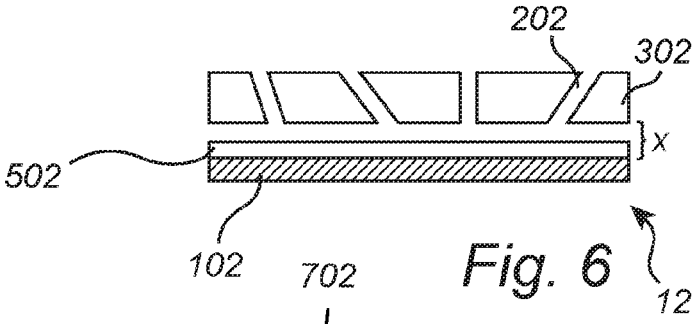

FIG. 6 shows another version of the lighting device 12 in which a diffuser 502 is arranged between the light source 102 and the optical element 302. In this way a uniform light distribution may be obtained before transmitting the light through the optical element 302.

Furthermore, the optical element 302 of the lighting device 12 shown in FIG. 6 is arranged in a distance x from the light source 102.

Figure 7:
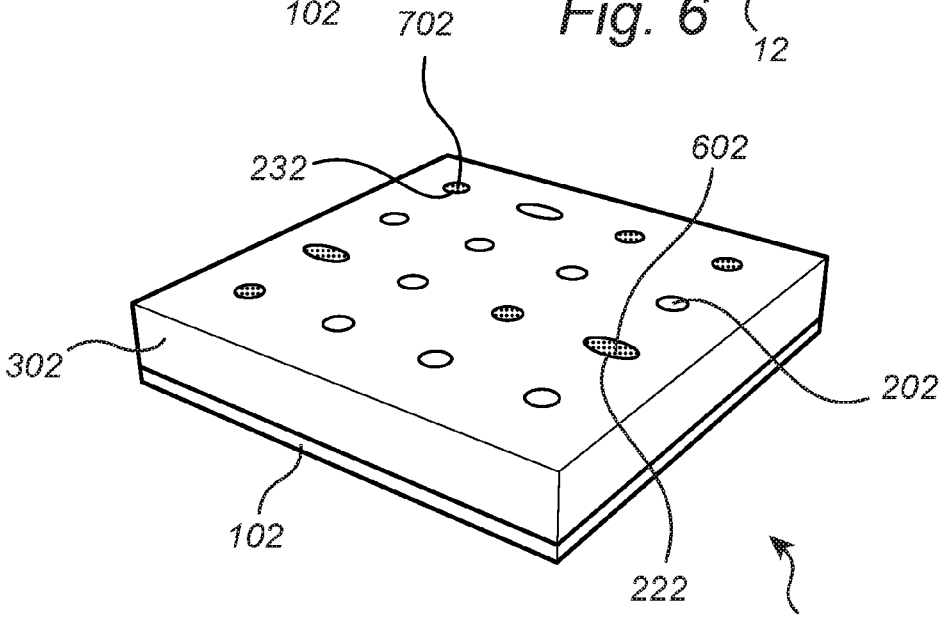

Referring to FIG. 7 yet another version of the lighting device 12 is shown. In this version, which is shown in perspective, the through openings 202, 222, 232 are provided with different cross sectional shapes. Particularly, the through opening 202 is circular in cross section, while the through opening 222 is elliptical in cross section.

Furthermore, one or more of the through openings, in FIG. 6 e.g. the through opening 222, is filled with a material 602 which is different from the material of the optical element 302. Thereby the light collimation properties may be improved. E.g. the through opening 222 may be filled with a polymer material such as polycarbonate (PC), poly (methyl methacrylate) (PMMA) or polyethylene therephthalate (PET).

Likewise, one or more of the through openings, in FIG. 6 e.g. the through opening 232, is filled with an optical rod 702, which is not in contact with the optical element. In this way total internal reflection (TIR) can be used to collimate the light in the through openings.

It is noted that obviously the through openings of the optical element(s) may be filled with a material or an optical rod as described above irrespective of the embodiment.

Embodiment 3

Figure 8:
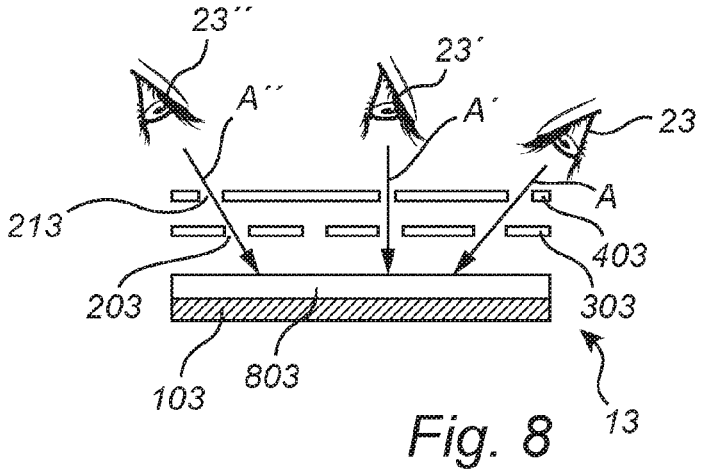
FIGS. 8 and 9 show schematic illustrations of two different versions of a third embodiment of a lighting device according to the invention comprising a light source and two optical elements in the form of diffusers with through holes.

FIG. 8 shows a lighting device 13 according to a third embodiment of the invention. The lighting device comprises a light source 103 and two optical elements 303, 403 arranged in front of the light source 103.

In this embodiment the two optical elements 303, 403 are diffusers that comprise a material being at least partially transparent. The two optical elements 303, 403 each comprise a plurality of through openings 203, 213 for collimating light emitted by the light source 103 such as to cause light emitted by the light source 101 to comprise a brightness varying with the direction of emission and thereby provide a sparkling effect.

As illustrated in FIG. 8, viewers 23, 23' and 23" looking at the lighting device 13 from the directions A, A' and A", respectively, will experience light with a brightness corresponding to light transmitted through the through openings in both optical elements. A viewer looking at the light source from another direction will experience light transmitted through one or both optical elements 303, 403, and thus having a different, typically lower, brightness. Thereby a sparkling effect is obtained when a viewer changes his point of view, e.g. from the direction A over the direction B to the direction A'.

The optical elements 303, 403 are in this embodiment provided with a relatively small thickness, e.g. a thickness of 0.1 mm or 0.2 mm, but may in principle also be provided with a larger thickness, e.g. a thickness of 0.5 mm, 1 mm, 2 mm or 3 mm. Also, the optical elements 303, 403 may be of different thicknesses.

Furthermore, the optical element 303 shown in FIG. 8 comprises four through openings 203, while the optical element 403 comprises three through openings 213. That is, the optical element 303 comprises a larger number of through openings than the optical element 403.

Obviously each of the optical elements 303 and 403 are not limited to comprising this number of through openings but may comprise any other number of through openings, in principle including just one through opening. Also, the optical elements 303 and 403 may comprise an identical number of through openings, or the optical element 403 may comprise a larger number of through openings than the optical element 303.

In a not shown version of the lighting device 13 the optical element 303 closest to the light source 103 is arranged in contact with the light source 103.

Furthermore, with reference to FIG. 8, a phosphor layer 803 is arranged between the light source 103 and the optical elements 303 and 403. As shown in FIG. 8, the phosphor layer 803 is arranged in contact with the light source 103.

Figure 9:
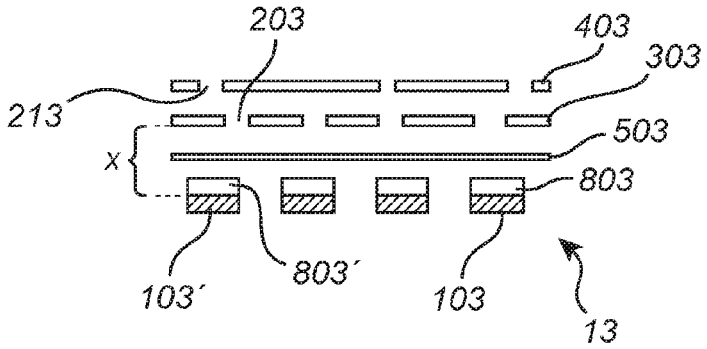

Turning now to FIG. 9, another version of the lighting device 13 is shown. In this version a diffuser 503 is arranged between the light source 103 and the optical elements 303 and 304. In this way a uniform light distribution may be obtained before transmitting the light through the optical elements 303, 304 providing the sparkling effect.

As shown in FIG. 9, the optical element 303 closest to the light source 103 is arranged in a distance x from the light source 103.

Furthermore, the large area lighting device 103 of the lighting device 13 shown in FIG. 9 comprises an array of light sources 103, 103' each provided with a phosphor layer 803, 803'.

Also, the phosphor layer 803, 803' may be provided as a phosphor layer or a phosphor coating or a phosphor element. Furthermore, the phosphor layer 803, 803' may alternatively be arranged in a distance from the light source.

In a not shown embodiment, one or both optical elements 303, 304 of a lighting device 13 according to the third embodiment of a lighting device according to the invention may be provided with a stepped configuration similar to that described above in relation to FIG. 3.

Embodiment 4

Figure 10:
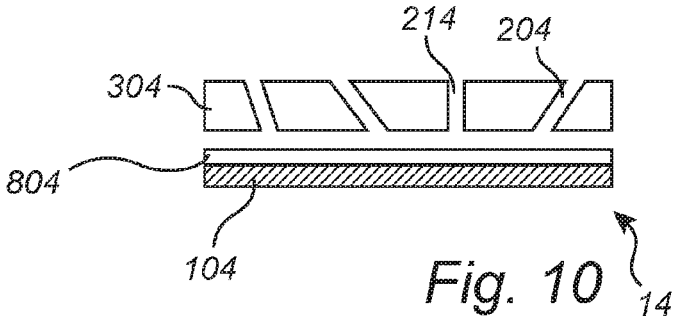
FIGS. 10 and 11 show schematic illustrations of two different versions of a fourth embodiment of a lighting device according to the invention comprising a light source and an optical element in the form of a diffuser with an increased thickness as compared to the optical elements of the first embodiment and with through holes.

FIG. 10 shows a lighting device 14 according to a fourth embodiment of the invention. The lighting device comprises a light source 104 and one optical element 304 arranged in front of the light source 104.

In this embodiment the optical element 304 is a diffuser that comprises a material being at least partially transparent. The optical element 304 comprises a plurality of through openings 204, 214 for collimating light emitted by the light source 104 such as to cause light emitted by the light source 104 to comprise a brightness varying with the direction of emission and thereby provide a sparkling effect in a similar way as described above in relation to the first, second and third embodiments.

The optical element 304 is in this embodiment provided with a relatively large thickness, e.g. a thickness of 0.5 mm, 1 mm, 2 mm or 3 mm, such that the through openings 204, 214 are provided as through channel- or tube-shaped openings.

As will be described further below with respect to FIGS. 12 to 14, the through openings 204, 214 may have one specific cross sectional diameter when measured on one surface of the optical element 304 and another specific cross sectional diameter when measured on the opposite surface of the optical element 304.

The through openings 204, 214 typically have a large aspect ratio measured as the length of the through opening divided by the diameter of the through opening. The aspect ratio may e.g. be at least 2, or at least 4, or at least 6.

For example, an optical element 304 with a thickness of 2 mm might have holes with a diameter of 300 μm. In another example, an optical element 304 with a thickness of 1 mm might have holes with a diameter of 100 μm.

Furthermore, a phosphor layer 804 is arranged between the light source 104 and the optical element 304. The phosphor layer 804 is arranged in contact with the light source 104.

Furthermore, the optical element 304 shown in FIG. 10 comprises four through openings 204, 214. Obviously the optical element 304 is not limited to comprising this number of through openings but may comprise any other number of through openings, in principle including just one through opening.

Figure 11:
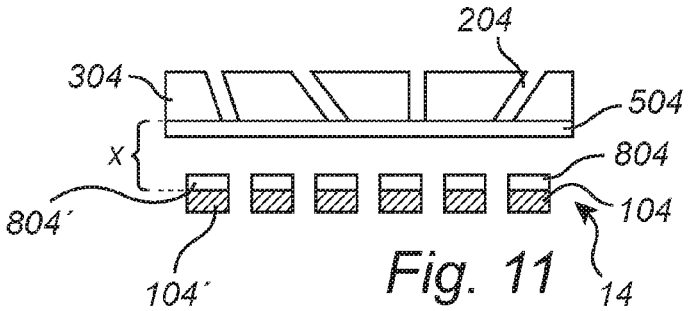

FIG. 11 shows another version of the lighting device 14 in which the optical element 304 is arranged in a distance x from the light source 104.

Furthermore, the large area lighting device 104 of the lighting device 14 shown in FIG. 11 comprises an array of light sources 104, 104' each provided with a phosphor layer 804, 804'.

Also, the phosphor layer 804, 804' may be provided as a phosphor layer or a phosphor coating or a phosphor element. Furthermore, the phosphor layer 804, 804' may alternatively be arranged in a distance from the light source.

As is also shown in FIG. 11 a diffuser 504 is arranged between the light source 104 and the optical element 304. In this way a uniform light distribution may be obtained before transmitting the light through the optical element 304 providing the sparkling effect.

In a not shown version of the lighting device 14 the through openings may be provided with different cross sectional shapes.

Furthermore, and likewise not shown, one or more of the through openings 204, 214 may be filled with a material which is different from the material of the optical element 304. Thereby the light collimation properties may be improved. E.g. a through opening may be filled with a polymer material such as polycarbonate (PC), poly(methyl methacrylate) (PMMA) or polyethylene therephthalate (PET). Likewise, one or more of the through openings may be filled with an optical rod, which is not in contact with the optical element. In this way total internal reflection (TIR) can be used to collimate the light in the through openings.

Embodiments of the Optical Element(s) and Through Opening(s)

Figure 12:
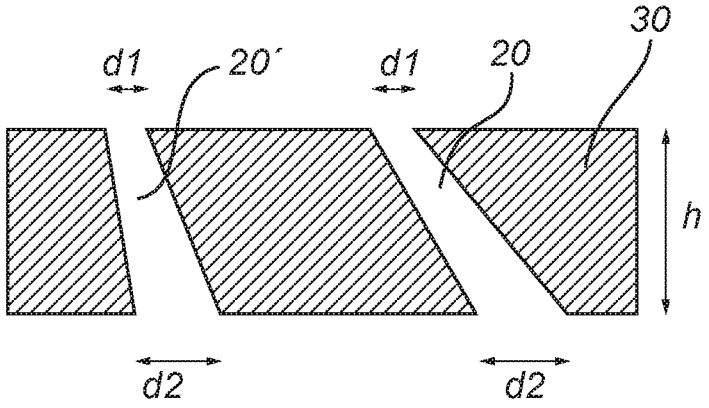
FIGS. 12 to 14 show schematic illustrations of different embodiments of the optical elements, and particularly of the through holes therein, of a lighting device according to the invention.
Figure 13:
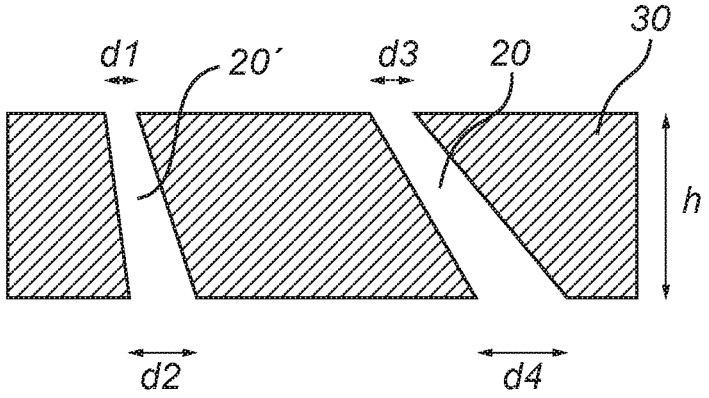
Figure 14:
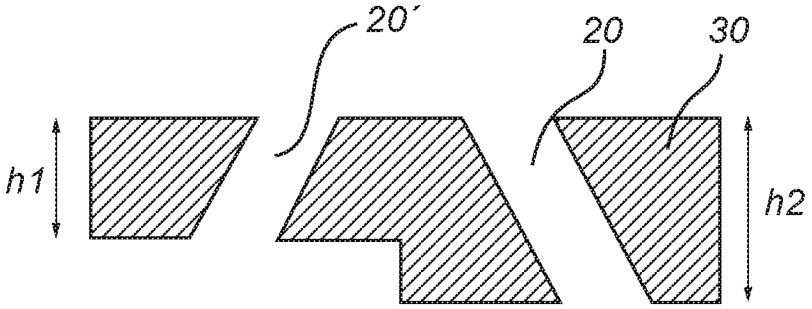

FIGS. 12 to 14 show schematic and non-limiting illustrations of different embodiments of an optical element 30, and particularly of the through holes 20 therein, of a lighting device according to the invention. These different embodiments may be used separately or in combination irrespective of the embodiment of the lighting device according to the invention, but however particularly in such embodiments as the second and fourth embodiment described above.

FIG. 12 shows an optical element 30 comprising a thickness h and two through openings 20, 20', which are positioned at different angles with respect to the opposite surfaces of the optical element 30, between which surfaces they extend. Also, the cross sectional diameter d1 of the through openings 20, 20' as measured on one surface of the optical element 30 is different from, here smaller than but may just as well be larger than, the cross sectional diameter d2 of the through openings 20, 20' as measured on the opposite surface of the optical element 30.

FIG. 13 shows an optical element 30 comprising a thickness h and two through openings 20, 20', which are positioned at different angles with respect to the opposite surfaces of the optical element 30, between which they extend. Also, the cross sectional diameter d1 of the through opening 20' as measured on one surface of the optical element 30 is different from, here smaller than but may just as well be larger than, the cross sectional diameter d2 of the through opening 20' as measured on the opposite surface of the optical element 30. Likewise, the cross sectional diameter d3 of the through opening 20 as measured on one surface of the optical element 30 is different from, here smaller than but may just as well be larger than, the cross sectional diameter d4 of the through opening 20 as measured on the opposite surface of the optical element 30. Furthermore, all four said cross sectional diameters d1, d2, d3 and d4 are different from one another.

Finally, FIG. 14 shows an optical element 30 comprising two through openings 20, 20', which are positioned at different, oppositely slanting, angles with respect to the opposite surfaces of the optical element 30, between which they extend. Furthermore, the optical element 30 comprises two different thicknesses h1 and h2 such that the optical element comprises a non-uniform thickness and one surface with a stepped configuration and that the through openings 20 and 20' are situated in different distances from a light source (not shown) when mounted in a lighting device according to the invention.

It is noted that it would also be feasible for the skilled person to combine the embodiments shown in FIGS. 12 to 14.

The person skilled in the art realizes that the present invention by no means is limited to the preferred embodiments described above. On the contrary, many modifications and variations are possible within the scope of the appended claims, including various combinations of the different embodiments of the large area light guide, optical elements and through openings of a lighting device according to the invention.

Additionally, variations to the disclosed embodiments can be understood and effected by the skilled person in practicing the claimed invention, from a study of the drawings, the disclosure, and the appended claims. In the claims, the word "comprising" does not exclude other elements, and the indefinite article "a" or "an" does not exclude a plurality. The mere fact that certain measures are recited in mutually different dependent claims does not indicate that a combination of these measures cannot be used to advantage.

The invention claimed is:

1. A lighting device, comprising:

a light source emitting light; and at least two optical elements arranged in front of said light source, said at least two optical elements comprising an at least partially transparent material such as to allow at least part of said light emitted by said light source to be transmitted therethrough, wherein said at least two optical elements comprise a plurality of through openings adapted for collimating said light emitted by said light source such as to cause light exiting said at least two optical elements to comprise a brightness varying with the direction in which said light exits said at least two optical elements, wherein a first optical element of the at least two optical elements comprises a first pair of adjacent through openings separated by a first distance and a second optical element of the at least two optical elements comprises a second pair of adjacent through openings separated by a second distance, the second distance being different than the first distance.

2. The lighting device according to claim 1, wherein said at least two optical elements are arranged mutually spaced apart.

3. The lighting device according to claim 1, wherein a diffuser is arranged between said light source and said at least two optical elements.

4. The lighting device according to claim 1, wherein any one of a phosphor element, a phosphor layer and a phosphor coating is arranged between said light source and said at least two optical elements.

5. The lighting device according to claim 1, wherein at least one optical element of the at least two optical elements is any one of a phosphor element and a diffuser.

6. The lighting device according to claim 1, wherein said plurality of through openings comprise two or more different sizes.

7. The lighting device according to claim 1, wherein said plurality of through openings comprises two or more different cross sectional shapes.

8. The lighting device according to claim 1, wherein said at least two optical elements comprise a different number of through openings.

9. The lighting device according claim 1, wherein one or more of said plurality of through openings are filled with a material being different to that of the optical element.

10. The lighting device according to claim 1, wherein one or more of said plurality of through openings are filled with an optical rod.

11. The lighting device according to claim 1, wherein at least one of said at least two optical elements comprises a non-uniform thickness.

12. The lighting device according to claim 1, wherein said plurality of through openings comprises an aspect ratio measured as the length of the through opening divided by the diameter of the through opening of at least 2.

13. The lighting device according to claim 1, wherein said light source is any one of a LED, a phosphor-converted LED, a LED-array, a phosphor-converted LED-array and a light guide.

14. A luminaire or a lamp comprising a lighting device according to claim 1.

* * * * *